US007954933B2

(12) United States Patent
Fung et al.

(10) Patent No.: US 7,954,933 B2
(45) Date of Patent: Jun. 7, 2011

(54) INK CARTRIDGE

(75) Inventors: Jinming Fung, Guangdong (CN); Qingguo Xiao, Guangdong (CN)

(73) Assignee: Print-Rite•Unicorn Image Products Co., Ltd. of Zhuhai, Zhuhai, Guangdong (CN)

( * ) Notice: Subject to any disclaimer, the term of this patent is extended or adjusted under 35 U.S.C. 154(b) by 840 days.

(21) Appl. No.: 10/580,374

(22) PCT Filed: Nov. 23, 2004 (Under 37 CFR 1.47)

(86) PCT No.: PCT/CN2004/001335
§ 371 (c)(1), (2), (4) Date: Dec. 17, 2007

(87) PCT Pub. No.: WO2005/051665
PCT Pub. Date: Jun. 9, 2006

(65) Prior Publication Data

US 2011/0069126 A1 Mar. 24, 2011

(30) Foreign Application Priority Data

Nov. 28, 2003 (CN) ..... 2003 1 0112411

(51) Int. Cl.
*B41J 2/175* (2006.01)

(52) U.S. Cl. ..... 347/86

(58) Field of Classification Search ..... 347/85, 347/86, 87
See application file for complete search history.

(56) References Cited

U.S. PATENT DOCUMENTS

| | | | | |
|---|---|---|---|---|
| 4,558,326 | A | 12/1985 | Kimura et al. | |
| 4,571,599 | A | 2/1986 | Rezanka | |
| 5,790,158 | A | 8/1998 | Shinada et al. | |
| 5,953,030 | A * | 9/1999 | Ishinaga et al. | 347/86 |
| 6,010,212 | A * | 1/2000 | Yamashita et al. | 347/86 |
| 6,270,207 | B1 * | 8/2001 | Sasaki | 347/86 |
| 6,332,673 | B1 | 12/2001 | Higuma et al. | |
| 6,467,890 | B1 | 10/2002 | Tajima et al. | |
| 6,520,630 | B1 * | 2/2003 | Oda et al. | 347/85 |

FOREIGN PATENT DOCUMENTS

| | | |
|---|---|---|
| EP | 0 765 756 B1 | 4/1997 |
| EP | 0 947 328 B1 | 10/1999 |

* cited by examiner

*Primary Examiner* — Anh T. N. Vo
(74) *Attorney, Agent, or Firm* — Fay Sharpe LLP

(57) ABSTRACT

An ink cartridge for inkjet printers is disclosed. The inkjet cartridge comprises a case, an ink supply chamber, and an ink storage chamber. The ink supply chamber and the ink storage chamber are inside the case. An ink outlet is provided on a sidewall of the case. The ink supply chamber is connected or linked in a low position with the ink outlet and in a high position with an air vent. The ink storage chamber is connected or linked in a low position with the ink supply chamber through a first passageway and a second passageway; the second passageway is below the ink outlet but above the first passageway. The cartridge has a simple structure. It eliminates the need of air pump and provides constant supply of ink to the print head. It avoids ink overflow caused by the temperature change in the environment.

7 Claims, 5 Drawing Sheets

INK CARTRIDGE

This application claims the benefit of PCT Patent Application Ser. No. PCT/CN2004/001335, filed on 23 Nov. 2004, and claims the benefit of Chinese Patent Application No. 200310112411.1, filed on 28 Nov. 2003, the disclosures of which are incorporated herein by reference.

FIELD OF THE INVENTION

The invention relates to an ink cartridge for use in inkjet printers.

BACKGROUND OF THE INVENTION

One known ink cartridge is featured to have a rigid case and a soft ink bag inside the case. For example, Chinese patent number CN1319502 discloses an ink cartridge which has an ink bag inside a sealed rigid case. Applying air pressure into the case presses the ink bag to supply ink to the print head. The case has a bottom part and a top part. After the ink bag is placed in the bottom part, the top part covers the bottom part and the case is then sealed.

Usually, the print head has a certain degree of suction to suck the ink from a level below the print head. However, if the ink level is too low, the print head cannot suck the ink by itself. An ink supply system is then needed. The ink cartridge disclosed in CN1319502 is suitable for use in this type of printer. The print head does not need any suction. An air pump provides constant air pressure to the case and induces pressure onto the ink bag to overcome the deficiency of the print head suction.

However, the known ink cartridge is very complex in structure and it thus is, expensive. It requires the printer to be equipped with an air pump. This increases the cost of the printer. Moreover, the ink cartridge cannot be refilled by ordinary users. The used cartridges need to be sent to professionals to refill. Further, air has a greater expansion coefficient than liquid ink. Therefore, if the ink cartridge is not used for a long period of time, the temperature change in the environment may generate pressure on the ink bag that pushes the ink overflow from the ink outlet, causing contamination.

SUMMARY OF THE INVENTION

The invention provides a novel ink cartridge. The cartridge has a simple structure. It eliminates the need for an air pump and provides a constant supply of ink to the print head. It avoids ink overflow caused by the temperature change in the environment.

The inkjet cartridge comprises a case, an ink supply chamber, and an ink storage chamber. The ink supply chamber and the ink storage chamber are inside the case. An ink outlet is provided on a sidewall of the case. The ink supply chamber is connected in a low position with the ink outlet and in a high position with an air vent. The ink storage chamber is connected in a low position with the ink supply chamber through a first passageway and a second passageway; the second passageway is below the ink outlet but above the first passageway.

DETAILED DESCRIPTION OF THE INVENTION

The inkjet cartridge comprises a case, an ink supply chamber, and an ink storage chamber. The case is preferably made from a transparent material. Preferably, at least one wall of the case is made from a transparent material. Suitable transparent materials include plastics. A transparent wall allows the printer users to observe the ink level and a timely ink refill therefore can be provided.

The ink supply chamber and the ink storage chamber are inside the case. An ink outlet is provided on a sidewall of the case. The ink outlet is used to supply ink from the ink cartridge to the print head. The ink supply chamber is connected in a low position with the ink outlet and in a high position with an air vent.

The ink storage chamber is connected in a low position with the ink supply chamber through a first passageway and a second passageway. The second passageway is below the ink outlet but above the first passageway. The first passageway transfers the ink from the ink storage chamber to the ink supply chamber. The second passageway allows the air flow from the ink supply chamber to the ink storage chamber.

Preferably, the ink supply chamber and the ink storage chamber share a wall as shown in Example 1. On the wall there are two small holes which can be used as the passageways. Alternatively, the first and second passageways can use tubes. If the tubes are not set horizontally, the inner top of the storage chamber should be above the highest point of the second passageway.

Preferably, on the top of the ink storage chamber is equipped an ink inlet. The ink inlet is used for refilling. It is sealed with a cap which can be easily opened during refilling.

Figure 1:
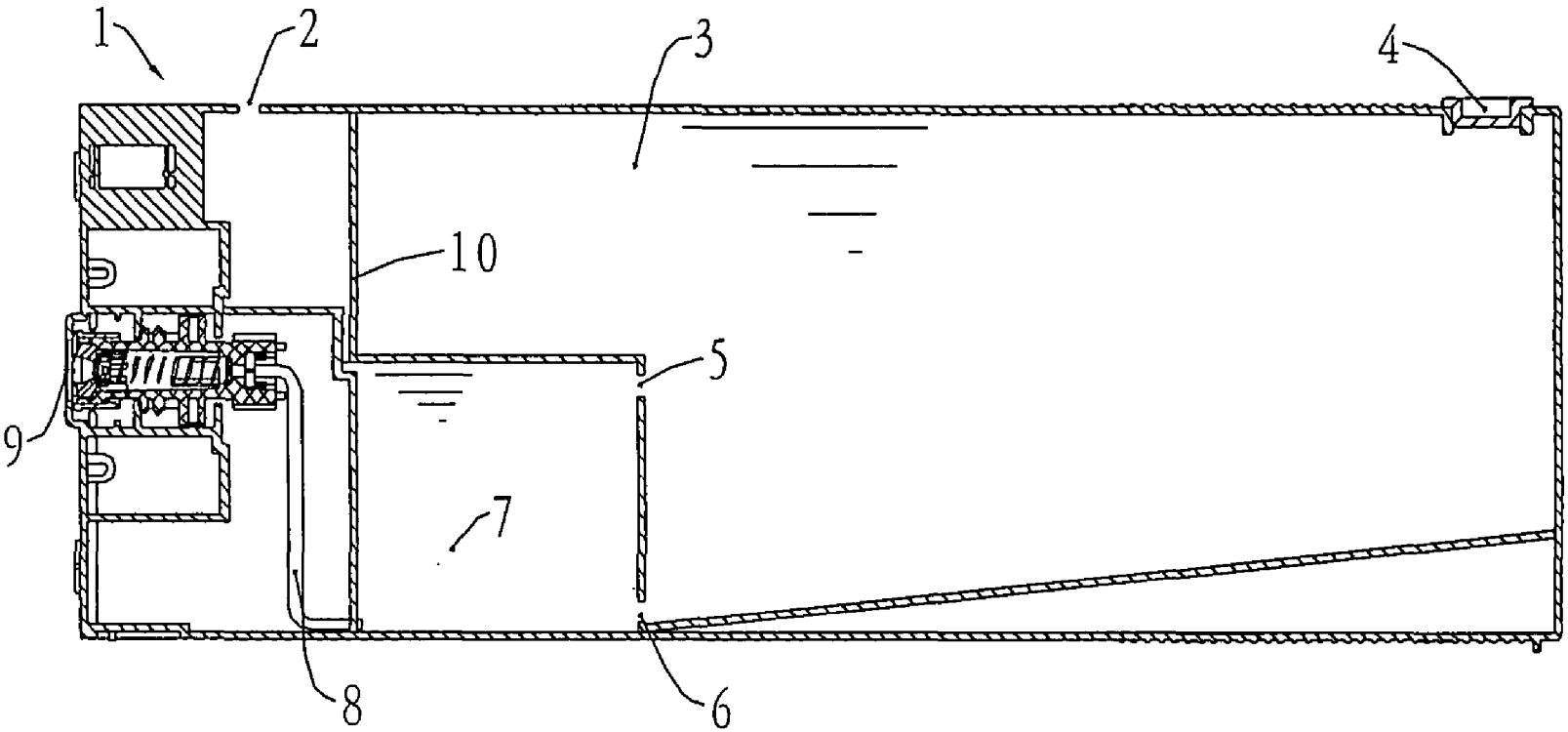
FIG. 1 illustrates the structural principle of Example 1.
Figure 4:
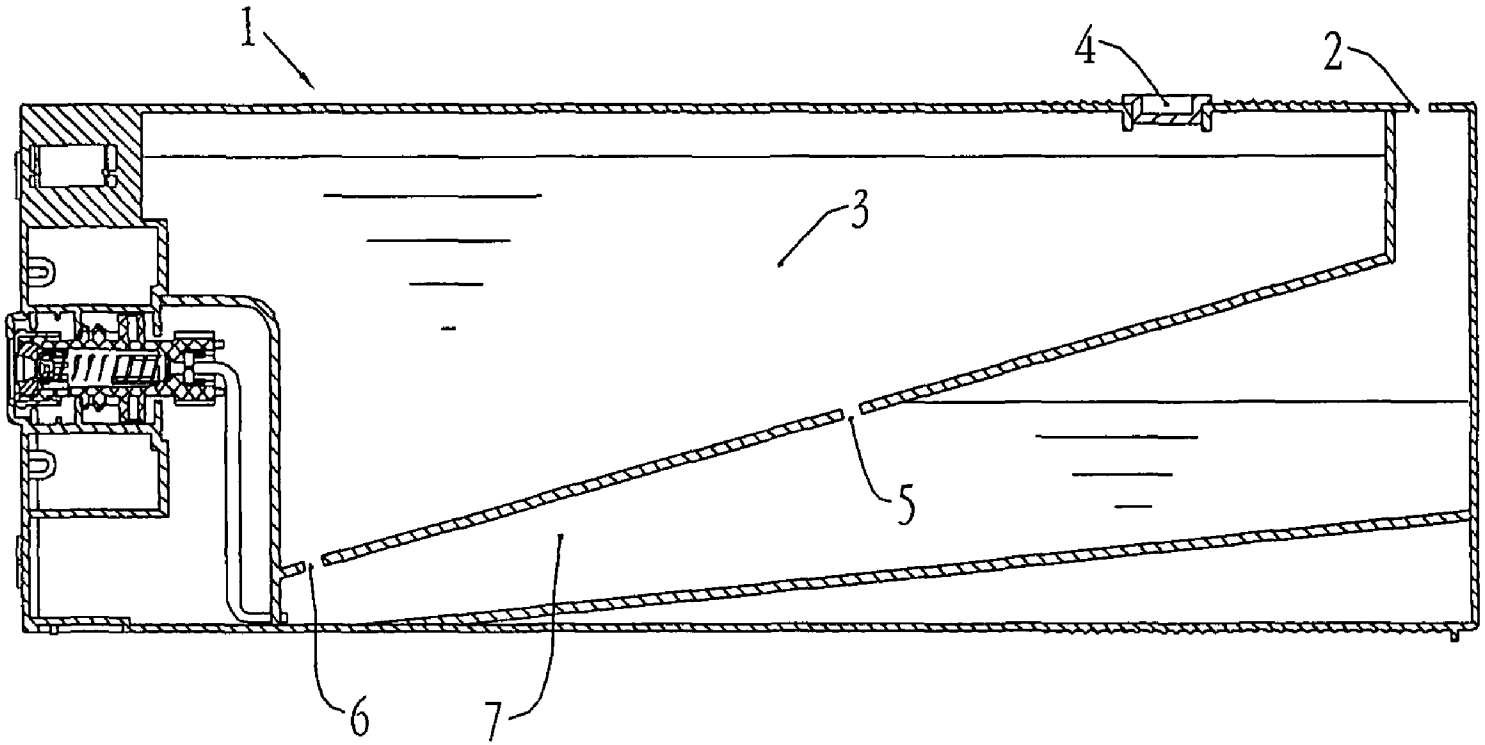
FIG. 4 illustrates the structure of Example 2.

The ink supply chamber and the ink storage chamber can be placed inside the case in any suitable ways. One way is as shown in FIG. 1 where the two chambers are set parallel and separated by a ⊢shaped wall. An alternative way is as shown in FIG. 4 where the ink storage chamber is set above the ink supply chamber. The wall between the two chambers has a positive slope so that the second passageway is located in a position higher than the first passageway.

Figure 5:
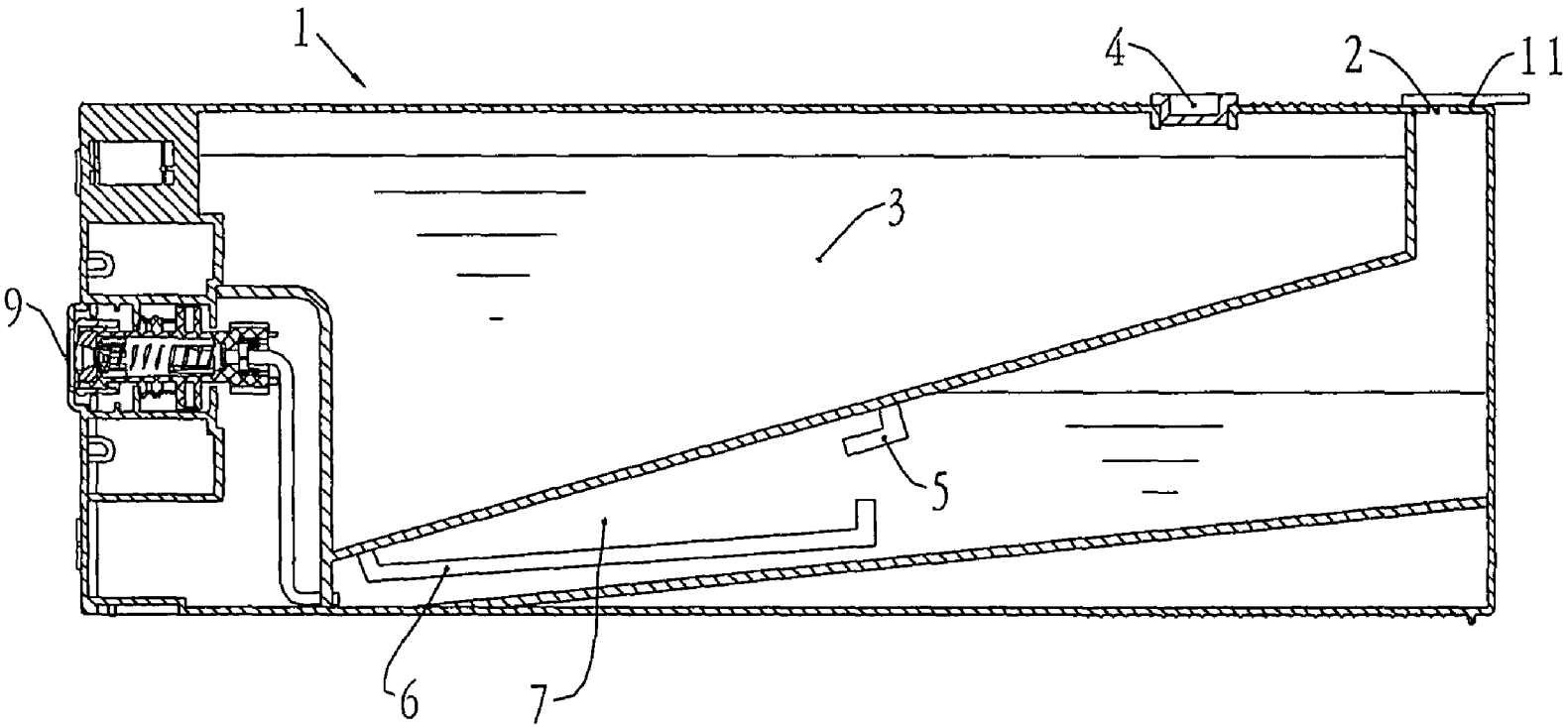
FIG. 5 illustrates the structure of Example 3.

Preferably, the passageways are structured as elbow shapes. One example of the elbow-shaped passageways is shown in FIG. 5. During transportation, the ink cartridges are often inclined or placed upside down. This may cause air to flow into the ink storage, chamber and the ink to flow into the ink supply chamber from the ink storage chamber. The increased ink level (higher than the ink outlet) in the supply chamber may cause ink overflow when the ink cartridge is installed to the printer. The overflow causes contamination. The elbow shaped structure prevents air from flowing into the ink storage chamber and therefore prevents the ink overflow.

During printing, the ink in the supply chamber is consumed and the ink level goes down. When the ink level in the supply chamber is below the second passageway, the air passes through the air vent and the ink supply chamber into the ink storage chamber and thus the ink flows from the storage chamber to the supply chamber through the first passageway. The ink level in the supply chamber therefore goes up. When the ink level in the supply chamber reaches the second passageway, the air flow is blocked. Therefore, the ink flow from the storage chamber to the supply chamber also stops. This circle continues till the storage chamber is empty. Since the ink level in the supply chamber is kept relatively constant during printing, the ink supply to the print head is also consistent.

The ink cartridge of the invention is further illustrated by the following examples.

EXAMPLE 1

FIG. 1 is a sectional view of an ink cartridge. The case 1 is made from plastic. On a sidewall of the case there is an ink outlet 9. The ink outlet 9 can be a check valve or similar control device. Inside the case 1 there are two chambers: an ink supply chamber 7 and an ink storage chamber 3. On the top of the supply chamber 7 there is an air vent 2. The bottom of the supply chamber 7 is connected or linked to an ink outlet 9 through a tube 8. The storage chamber 3 and the supply chamber 7 are separated by a wall 10. A small hole 6 on the bottom of the wall 10 is used as a first passageway to connect the supply chamber 7 and the storage chamber 3. Another small hole 5 on the wall 10 is used as a second passageway to connect the supply chamber 7 and the storage chamber 3. The second passageway 5 is located above the first passageway 6 but below the ink outlet 9. On the top of the storage chamber 3, there is an ink inlet 4. The ink inlet 4 is sealed with a cap which can be opened when the storage chamber is refilled.

Figure 2:
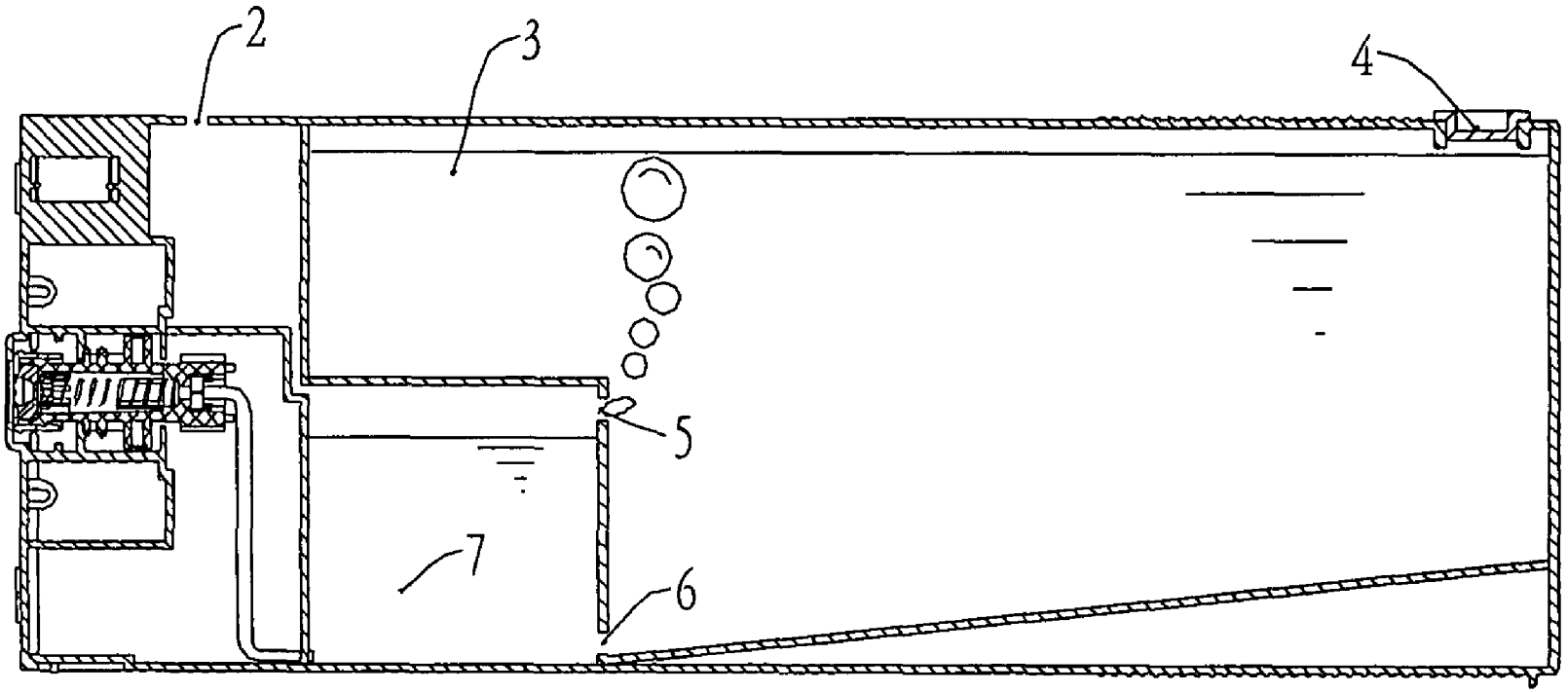
FIG. 2 illustrates the ink flow from the storage chamber to the ink supply chamber of Example 1.

As shown in FIG. 2, when the ink cartridge is installed on the printer, the ink outlet 9 is connected with the print head horizontally. In a new cartridge, the storage chamber 3 is full of ink. The supply chamber 7 has an ink level above the second passageway 5. Under atmosphere pressure, there is no ink flow between the supply chamber 7 and the storage chamber 3. During printing, the ink in the supply chamber 7 is gradually consumed. When the ink level in the supply chamber 7 goes under the second passageway 5, the air flows into the storage chamber 3 and the ink flows from the storage chamber 3, through the first passageway 6, into the supply chamber 7. The ink level in the supply chamber 7 therefore goes up. When the ink level goes above the second passageway 5, the ink blocks the air flow. The ink flow from the storage chamber 3 to the supply chamber 7 also stops. During this process, the ink level in the supply chamber 7 has very small change so that the ink supply to the print head remains consistent. After the ink level in the storage chamber 3 reaches the second passageway 5, the ink in both chambers remains at the same level until all of the ink is consumed.

Figure 3:
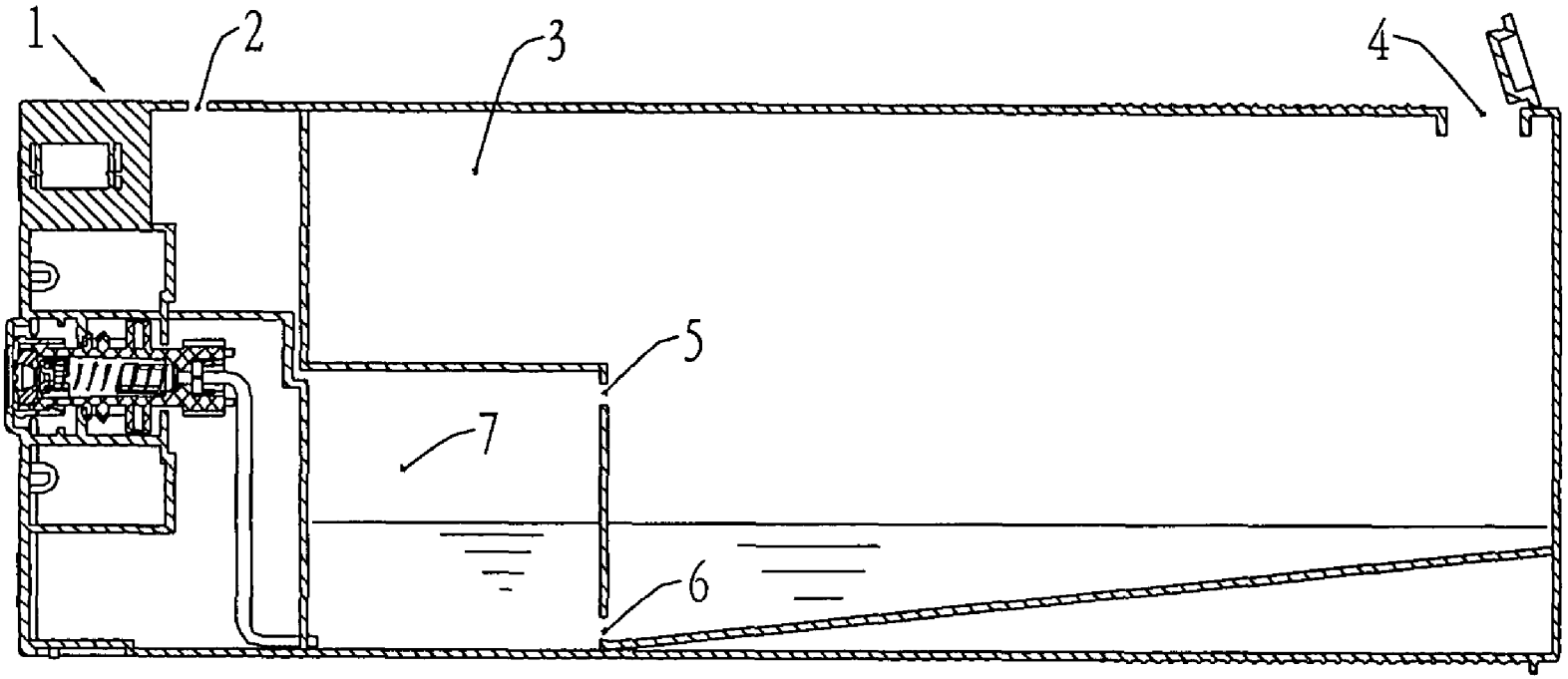
FIG. 3 illustrates the cartridge refilling.

As shown in FIG. 3, before the ink in both chambers is used up, the printer user can conveniently refill the ink storage chamber 3 from the ink inlet 4. If the printer is not used for a long period of time, a sudden temperature change of the environment may cause an expansion of air in the space of the storage chamber 3 and generate pressure which pushes the ink to flow into the supply chamber 7. Because there is enough space between the second passageway 5 and the air vent 2 to hold the ink from the storage chamber 3, the ink does not overflow out of the case 1 to cause contamination.

If there is no wall between the supply chamber and the storage chamber, the first and second passageways can be tubes. If the tubes are not set horizontally, the inner top of the storage chamber should be above the highest point of the second passageway.

The case 1 can be made by a transparent material. At least one of the walls, for example, the backside wall of the case 1 is made by a transparent material. The printer users can observe the ink level of the ink storage chamber 3 and a timely ink refill can be provided.

EXAMPLE 2

As shown in FIG. 4, this example differs from Example 1 in that the ink supply chamber 7 and the ink storage chamber 3 are set differently. In Example 1, two chambers are set parallel and separated by a ⊥angle-shaped wall. In this Example, the ink storage chamber 3 is set above the ink supply chamber 7. The wall between the two chambers has a positive slope so that the second passageway is located in a position higher than the first passageway. In addition, the air vent 2 is located close to the ink inlet 4 so that the ink refilling is more convenient.

EXAMPLE 3

During transportation, the ink cartridges are often inclined or placed upside down. This may cause air flow into the ink storage chamber 3 and the ink flow into the ink supply chamber 7 from the ink storage chamber 3. The increased ink level (higher than the ink outlet 9) in the supply chamber 7 may cause ink overflow when the ink cartridge is installed on the printer and thus causes contamination. As shown in FIG. 5, this example differs from Example 2 in that the first and the second passageways 6 and 5 are structured as elbow shapes. In addition, the air vent 2 is sealed by a film 11. This structure prevents the ink from leaking during transportation.

These examples merely illustrate the invention. Those skilled in the art will recognize many variations that are within the spirit of the invention and scope of the claims.

We claim

1. An ink cartridge comprising a case, an ink supply chamber, and an ink storage chamber, wherein the ink supply chamber and ink storage chamber are inside the case, an ink outlet is equipped on a sidewall of the case, the ink supply chamber is connected in a low position with the ink outlet and in a high position with an air vent, wherein the ink storage chamber is connected in a low position with the ink supply chamber through a first passageway and a second passageway, the second passageway is below the ink outlet and above the first passageway.

2. The ink cartridge of claim 1 wherein an inner top of the ink storage chamber is above a highest point of the second passageway.

3. The ink cartridge of claim 2 wherein the inner top of the ink storage chamber is equipped with an ink inlet.

4. The ink cartridge of claim 2 wherein the ink supply chamber and the ink storage chamber are separated by a wall and the first and second passageways are small holes on the wall.

5. The ink cartridge of claim 1 wherein the inner top of the ink storage chamber is equipped with an ink inlet.

6. The ink cartridge of claim 1 wherein the ink supply chamber and the ink storage chamber are separated by a wall and the first and second passageways are small holes on the wall.

7. The inkjet cartridge of claim 6 wherein the ink storage chamber has at least one visible wall which is made from a transparent material.

* * * * *